US006676128B2

(12) United States Patent
Wolf

(10) Patent No.: US 6,676,128 B2
(45) Date of Patent: Jan. 13, 2004

(54) METHOD OF PLAYING A WAGERING CARD GAME

(76) Inventor: Fred Wolf, 10418 Lubao Ave., Chatsworth, CA (US) 91311

( * ) Notice: Subject to any disclaimer, the term of this patent is extended or adjusted under 35 U.S.C. 154(b) by 0 days.

(21) Appl. No.: 09/998,778

(22) Filed: Dec. 3, 2001

(65) Prior Publication Data

US 2002/0101035 A1 Aug. 1, 2002

Related U.S. Application Data

(60) Provisional application No. 60/250,884, filed on Dec. 4, 2000.

(51) Int. Cl.[7] ..... A63F 1/00
(52) U.S. Cl. ..... 273/292; 273/236; 273/274
(58) Field of Search ..... 273/292, 236

(56) References Cited

U.S. PATENT DOCUMENTS 3,689,071 A * 9/1972 Kucera ..... 273/281
5,072,946 A * 12/1991 Miller ..... 273/292
5,249,809 A * 10/1993 Wolf ..... 273/274
5,275,415 A * 1/1994 Wisted ..... 273/274
5,288,081 A * 2/1994 Breeding ..... 273/292
5,314,194 A * 5/1994 Wolf ..... 273/292
5,366,228 A * 11/1994 Kangsanaraks ..... 273/292
5,397,128 A * 3/1995 Hesse et al. ..... 273/292
5,411,268 A * 5/1995 Nelson et al. ..... 273/292
5,437,462 A * 8/1995 Breeding ..... 273/292
5,452,900 A * 9/1995 Skratulia et al. ..... 273/292
5,496,038 A * 3/1996 Kangsanaraks ..... 273/292
5,549,300 A * 8/1996 Sardarian ..... 273/292
5,620,183 A * 4/1997 Skratulia ..... 273/146
5,653,445 A * 8/1997 Quach ..... 273/292
5,678,821 A * 10/1997 Hedman ..... 273/292
5,690,335 A * 11/1997 Skratulia ..... 273/292
5,702,106 A * 12/1997 Alvarez, Jr. ..... 273/292
5,788,241 A * 8/1998 Ung ..... 273/292
5,826,976 A * 10/1998 Skratulia ..... 700/93
6,182,968 B1 * 2/2001 Wilkinson ..... 273/292

* cited by examiner

*Primary Examiner*—Benjamin H. Layno
*Assistant Examiner*—Dolores R. Collins
(74) *Attorney, Agent, or Firm*—Peter A. Borsari

(57) ABSTRACT

A method of playing a wagering card game in which a dealer and up to eight (8) players participate in a Blackjack-type card game comprising the placing of a wager by each of the players, the selection of an action player; commencing with the action player, the dealing of a hand to each of the players and the dealer, commencing with dealer and followed by the action player, the acting on each hand by standing or taking a hit, and initiating the fast action play, commencing between the dealer and the action player.

46 Claims, 6 Drawing Sheets

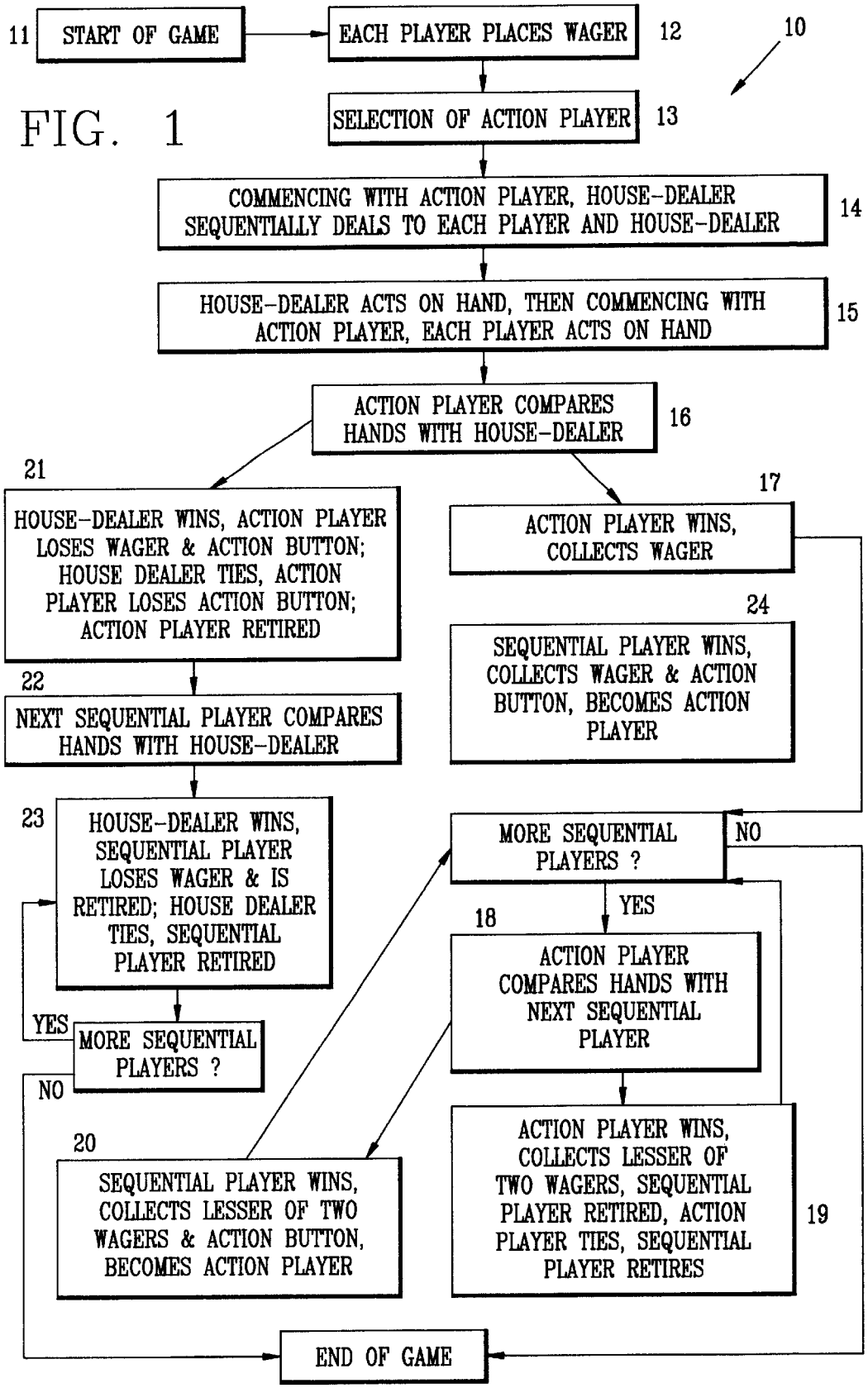
FIG. 1
10
11
START OF GAME
EACH PLAYER PLACES WAGER
12
SELECTION OF ACTION PLAYER
13
COMMENCING WITH ACTION PLAYER, HOUSE-DEALER SEQUENTIALLY DEALS TO EACH PLAYER AND HOUSE-DEALER
14
HOUSE-DEALER ACTS ON HAND, THEN COMMENCING WITH ACTION PLAYER, EACH PLAYER ACTS ON HAND
15
ACTION PLAYER COMPARES HANDS WITH HOUSE-DEALER
16
21
HOUSE-DEALER WINS, ACTION PLAYER LOSES WAGER & ACTION BUTTON; HOUSE DEALER TIES, ACTION PLAYER LOSES ACTION BUTTON; ACTION PLAYER RETIRED
17
ACTION PLAYER WINS, COLLECTS WAGER
24
SEQUENTIAL PLAYER WINS, COLLECTS WAGER & ACTION BUTTON, BECOMES ACTION PLAYER
22
NEXT SEQUENTIAL PLAYER COMPARES HANDS WITH HOUSE-DEALER
23
HOUSE-DEALER WINS, SEQUENTIAL PLAYER LOSES WAGER & IS RETIRED; HOUSE DEALER TIES, SEQUENTIAL PLAYER RETIRED
MORE SEQUENTIAL PLAYERS ?
NO
YES
18
ACTION PLAYER COMPARES HANDS WITH NEXT SEQUENTIAL PLAYER
YES
MORE SEQUENTIAL PLAYERS ?
NO
20
SEQUENTIAL PLAYER WINS, COLLECTS LESSER OF TWO WAGERS & ACTION BUTTON, BECOMES ACTION PLAYER
ACTION PLAYER WINS, COLLECTS LESSER OF TWO WAGERS, SEQUENTIAL PLAYER RETIRED, ACTION PLAYER TIES, SEQUENTIAL PLAYER RETIRES
19
END OF GAME

METHOD OF PLAYING A WAGERING CARD GAME

RELATED APPLICATION INFORMATION

This application claims the benefit of priority of U.S. provisional application Ser. No. 60/250,884, filed in the United States Patent & Trademark Office on Dec. 4, 2000 in the name of Fred Wolf and entitled Method of Playing a Card Game.

FIELD OF INVENTION

The present invention relates to wagering card games, and in particular relates to a method of playing a wagering card game of the Blackjack variety which utilizes and action player and a fast action round. The present invention also relates to a method of playing a wagering card game which can include a house dealer for play where gambling against a casino house is legal, or a player-dealer for play where gambling against a casino house is illegal.

BACKGROUND OF THE INVENTION

Card games of the Blackjack variety are well known in the prior art and are particularly popular as wagering card games in casinos. In such games, the cards have established numerical values, such as ace equals one or eleven, face cards equal ten and all other cards equal their face values (e.g. a two has a numerical value of two, a three has a numerical value of three, etc.). To play these card games, a player tries to reach an established target numerical total by sequentially accumulating cards and summing their numerical values. Typically, two cards initially are dealt, and the player then has the option of either (1) "standing" with the two cards, or (2) requesting and being dealt one or more additional cards ("hits").

The most common form of these games is the game of "Blackjack" or "21" wherein the established target numerical total is the value 21. A player wins a wager if the numerical total of the player's cards is less than or equal to 21 and is closer to 21 than the numerical total of the dealer's cards. If the numerical total of the player's or dealer's cards exceeds 21, the respective hand is a "bust", and loses to any hand having a numerical total of 21 or less.

Conventional rules of the card game Blackjack (Twenty-One) are well known in the prior art and can be found in several references including the following: (1) Scarne's New Complete Guide to Gambling, John Scarne, Harper & Row, New York, 1973; (2) Scarne's Encyclopedia of Games, John Scarne, Harper & Row, New York, 1973; (3) Hoyle's Modern Encyclopedia of Card Games, W. Gibson, Doubleday and Company, New York, and (4) Official Rule of Card Games, Albert H. Morehead, Fawcett Crest, New York, 1990.

In many states, such as California, Blackjack is illegal. Therefore, other similar Blackjack-type games have been devised. One such game is "California Blackjack", as described in U.S. Pat. No. 5,275,415 to Wisted, issued Jan. 4, 1994, wherein the established numerical total is the value 22. In "California Blackjack", a player tries to get closer to 22 than the dealer (usually a "player banker"). If the player's numerical total exceeds 22, the hand is not "bust". Other established numerical target totals are of course possible. For example, in U.S. Pat. No. 5,549,300 to Sardarian, issued Aug. 27, 1996, the target numerical sum is 20. In fact, any target numerical sum that is consistent with the established values of the cards may be used.

A method of playing a wagering game is disclosed in U.S. Pat. No. 5,452,900 to Skratulia et al., issued Sep. 26, 1995, in which the use of an action player and a fast action bank is developed as an adjunct to numerous existing games, including Pan Nine, Pai Gow Poker, California Blackjack and Blackjack Jokers. In this type of wagering game, the players actively participate against one another by comparing hands and settling wagers in a sequential manner. However, in Skratulia et al., the dealer only deals cards to the several players and otherwise does not participate in the playing of the game.

Despite the development of Blackjack-type card games and methods of wagering, a need still exists for a wagering card game which is of the Blackjack variety and which includes a dealer who can participate in the playing of the game. Such a wagering card game should be adaptable for play against a casino house as well as in other casinos where playing against the house is illegal. Such a wagering card game also should utilize an action player and a fast action round in order to enable players to actively participate against one another. Moreover, such a wagering card game should increase player excitement by providing the opportunity for a single player to win multiple wagers in a single hand by winning against multiple players. Further, such a wagering card game should appeal to Blackjack players as well as encourage new players. In addition, such a wagering card game should increase the revenues of each table.

SUMMARY OF THE INVENTION

Accordingly, it is an object of the present invention to provide a method of playing a wagering card game in which a dealer can be a participant in the playing of the game even in jurisdictions where playing against a casino house is illegal.

It is also an object of the present invention is to provide a method of playing a wagering card game which can be adapted both for play against a casino house and for play where wagering against a casino house is illegal.

It is another object of the present invention is to provide a method of playing a wagering card game which utilizes a fast action player and fast action play.

It is an additional object of the present invention is to provide a method of playing a wagering card game which increases player excitement and which creates the opportunity for a player to win multiple wagers in a single hand by winning against several other players.

It is a further object of the present invention is to provide a method of playing a wagering card game which appeals to Blackjack players and which will encourage new players.

It is still another object of the present invention is to provide a method of playing a wagering card game which increases the revenues of each table.

Additional objects, advantages and novel features of the invention will be set forth in part of the description which follow, and in part will become apparent to those skilled in the art upon examination of the following specification and claims or may be learned by practice of the invention.

These and other objects of the present invention are accomplished by providing a method of playing a wagering card game in which a dealer and four (4) to eight (8) players participate in a Blackjack-type card game comprising the placing of a wager by each of the players; the selection of an action player; the dealing of a hand to each of the players and the dealer, commencing with the action player; the acting on each hand by each of the players and the dealer, commencing with the dealer; and, initiating the fast action round, commencing between the dealer and the action player.

BRIEF DESCRIPTION OF THE DRAWINGS

The present invention will be better understood with reference to the appended drawing sheets, wherein:

FIG. 1 is a flow diagram illustrating the several steps of playing one embodiment of the wagering card game of the present invention.

DETAILED DESCRIPTION

The present invention relates to a method of playing a wagering card game, particularly a wagering card game of the Blackjack variety. The method includes the selection of an action player and a fast action round between the action player and each of the sequential players placing a wager. The use of fast action play is described in U.S. Pat. No. 5,452,900 to Skratulia et al, issued Sep. 26, 1995, the disclosure of which is hereby incorporated by reference. Because of the fast action play, player excitement is increased since is possible for a player to win a large amount of money on a single hand by winning against several other players. For example, if a player has a good hand, for example a "21", and the player is the action player, it is possible that the player can win from all of the other players as well as the dealer.

The present method of playing a wagering card game has three preferred embodiments. In the first embodiment, hereinafter sometimes referred to as "Game One", the dealer is an employee of the casino house and is a participant of card game; this dealer hereinafter is referred to as the "house-dealer". Card Game One can be played wherever gambling against the house is legal, including for example, Nevada, Indian, Atlantic City and Riverboat casinos, where Blackjack is legal. In the second embodiment, hereinafter sometimes referred to as "Card Game Two", the dealer is an employee of the casino house but is not a participant of the card game; this dealer hereinafter is referred to as the "card dealer'. Card Game Two can be played in states or local areas where play against a house/dealer is illegal. The third embodiment, hereinafter sometimes referred to as "Card Game Three" is a variation of Card Game Two. In Card Game Three, the card dealer is selected from the group of players; this dealer hereinafter is referred to as the "player-dealer". Card Game Three can be played in states or local areas where play against a house/dealer is illegal.

In Card Game One, like the conventional game of Blackjack, the object of the game is to reach, but not exceed, a numerical total of 21. Cards are valued as in conventional Blackjack. However, in a preferred embodiment, a "natural 21", that is Ace/King, Ace/Queen, Ace/Jack or Ace/Ten beats all other hands totaling to 21. Other differences between Card Game One and conventional Blackjack include the following:

(a) an action player is selected for each hand;

(b) the house-dealer is the first, not last, to act;

(c) the house-dealer's cards are dealt face up;

(d) the house-dealer must hit on an 11 or less and on soft 17, and must stand on hard 12 or more, or on soft 18 or more;

(e) the fast action play concept of U.S. Pat. No. 5,452,900 is utilized, and (f) players are not allowed to split pairs or double down.

Figure 2:
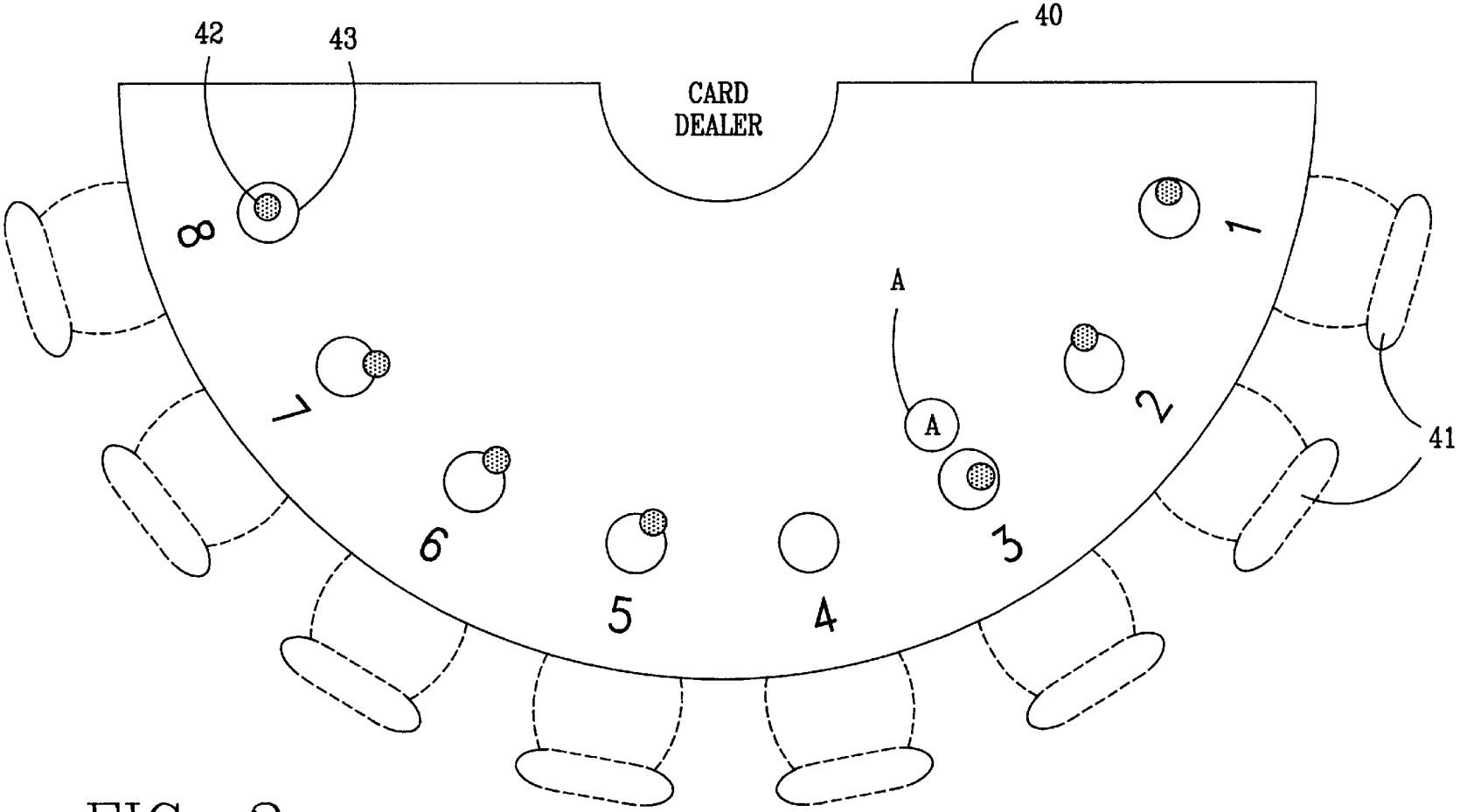
FIG. 2 is a plan view of a playing table layout of one embodiment of the present invention.

The method of playing Card Game One, generally designated 10 is shown in the flow diagram of FIG. 1, which illustrates the steps of play. FIG. 2 shows a typical table layout adapted to accommodate the house-dealer and up to eight (8) players. Referring now to FIGS. 1 and 2, the method of play, generally designated 10 comprises a series of steps, beginning with step 11, which is the start of Card Game One. Each player places a wager 42 in the respective betting area 43, directly in front of the respective player on playing table 40, in the next step, wagering step 12. The playing table 40 includes a plurality of playing positions 41, preferably eight (8) playing positions, representing playing positions one (1) through eight (8) respectively. The wagers of each of the players can be identical, can be identical and equal a predetermined table limit, or can be varied but within the table limit. The house-dealer will cover the largest allowable wager placed on the table if the hand comes into play against the house-dealer's hand. In an alternate embodiment, the house-dealer can require each player to contribute a table collection fee which is retained by the house in step 12. The table collection fee can be any legally acceptable amount established by the house. Preferably, the table collection fee per player per hand is between about $0.50 and $2.00.

After all of the players have placed their wagers 42, an action player is selected in step 13. The action player can be selected by any fair and arbitrary method. For example, the action player can be determined by cutting cards from the deck until a number card is turned up corresponding to a seated player position. The action player also can be determined by the cutting of cards from the deck and the player being cut the highest value card is selected as the action player (in instances of a tie, the cards are cut among the tying players until one player has been cut the highest value card). Preferably, the action player is selected by the rolling of three special dice as described in U.S. Pat. No. 5,620,183 to Skratulia, issued Apr. 15, 1997, the disclosure of which is incorporated herein by reference. When these three dice are rolled together, a total of one to eight will be produced. Whatever total is rolled, the player seated at that playing position will be the selected action player. If the seat is unoccupied, the set of three dice are rolled again. The use of these three dice are simple to use, speed up the play of the game and eliminate the need for counting around the table. In another preferred embodiment, after the conclusion of the first game, the action player for the next games can be selected by rolling the three dice to obtain a total of one to eight and then counting the occupied playing positions in a clockwise manner from the winner of the previous game. For example, if the total rolled on the dice is three (3) and the winner of the previous game is seated in playing position five (5) and all eight playing positions are occupied, then the new action player is selected by counting out three (3) beginning with playing position five (5). Thus, the new action player will be seated in playing position seven (7). When there are less than eight players, empty seated positions are not counted Once the action player has been selected, an action button A is placed next to the action player's betting area 43 and the game proceeds to step 14 in which the house-dealer sequentially deals cards to the players and to the house-dealer. The action player receives the first card and the rest of the cards are dealt in clockwise order around the table, including the house-dealer until each player and the house-dealer have two cards. Each of the player's two cards are dealt face-down while the house-dealer's two cards are dealt face-up. In step 15, the house-dealer is the first to act by standing (i.e. taking no cards) or drawing one or more additional cards (i.e. taking a "hit"). The house-dealer must hit when the numerical total of his cards equals 11 or less and on "soft 17" (the numerical total of three or more cards equaling 17), and must stand on "hard 12 or more" (the numerical total of two cards equaling 12 or more) or on "soft 18 or more". After the house-dealer completes his draw, the action player acts on his hand, followed by each sequential player until each player has acted on his hand. The play then proceeds to the fast action round using fast action play beginning with step 16.

In step 16, the action player and house-dealer compare hands. If the house-dealer has the better hand, the action player is retired from the fast action round and loses his wager, as illustrated in step 21, with the action button 43 being passed to the house-dealer. If the house-dealer has a tying hand, the action player receives back his wager and is retired from the game; the action button 43 is passed to the house-dealer. When there are more sequential players, the next sequential player acts compares his hand with the house-dealer in step 22. As illustrated in step 23, if the house dealer has the better hand, the sequential player loses his wager and is retired from the fast action round; if the house-dealer has a tying hand, the sequential player receives back his wager and is retired. Steps 22 and 23 are repeated if the house-dealer has a tying hand or the better hand until the house-dealer has been beaten or if all players have participated, thereby ending the game. If the next sequential player has the better hand as illustrated in step 24, he collects his wager and the action button 43 is passed to him. In this manner, when a sequential player beats the house-dealer hand, he becomes the action player and proceeds to step 18.

If the action player has the better hand as illustrated in step 17, the action player is declared the winner and collects the wager 42 and the house-dealer is retired from the fast action round. When the action player has the better hand against the house-dealer, the fast action round continues to step 18 and the action player and next sequential player compare hands. If the action player has the better hand, as illustrated in step 19, he collects the lesser of the two wagers and the sequential player is retired from the fast action round. For example, if the next sequential player's wager is $20.00 and the action player's wager is $30.00 and the action player has the better hand, the action player collects $20.00 from the next sequential player. If the next sequential player has the better hand, he collects only $20.00, as $20.00 is the lesser of the two wagers. When there is a tie between the action player and next sequential player, the action player retains the action button while the next sequential player receives back his wager as illustrated in step 19. When the sequential player has the better hand, he collects the lesser of the two wages and receives the action button, thereby becoming the action player as illustrated in step 20. Steps 18, 19 and 20 are repeated until all players have participated in the fast action round.

Thus, the action player wins a wager every time his hand is compared to a lower-ranking hand and the action player continues fast action play by the repeating of steps 18 and 19 with the next sequential player, unless he has a losing hand. Only when a sequential player has a better hand than the action player does that sequential player receive the action button 43 and become the new action player and proceed to fast action play by the repeating of steps 18 and 19.

Once the fast action round has commenced, each sequential player has the option to surrender when it is his turn to act in step 15. In other words, rather than acting on his hand, the sequential player can opt to surrender. The option of surrender allows the player to withdraw from the current round of play and receive back one-half (½) of his wager. However, no player can surrender when a player has exposed a Blackjack (a natural 21). When the hand of any player is a Blackjack (a natural 21), that player must not expose the Blackjack hand until it is his turn to act. When it is that player's turn to act, the Blackjack hand then is turned face-up. Once a Blackjack hand is exposed, none of the other remaining sequential players are allowed to draw cards or surrender. In an alternative embodiment, when at least seven (7) playing positions are occupied, the last sequential player can surrender and receive back one-half (½) of his wager when a previous sequential player has exposed a Blackjack. In another alternative embodiment, when all eight (8) playing positions are occupied, the last two sequential players can surrender and receive back one-half (½) of his wager when a previous sequential player has exposed a Blackjack.

Figure 3:
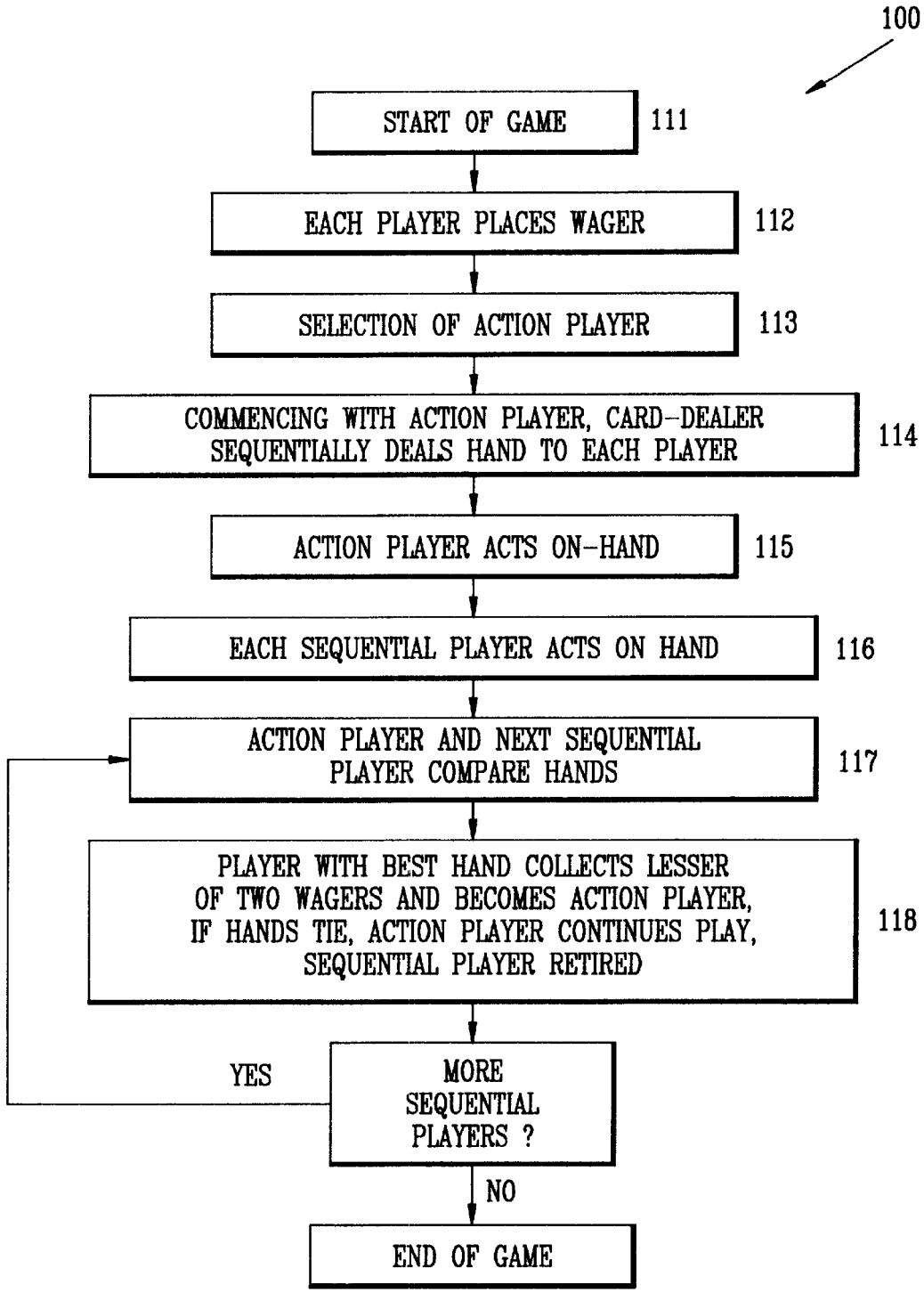
FIG. 3 is a flow diagram illustrating the several steps of playing a second embodiment of the wagering card game of the present invention.
Figure 4:
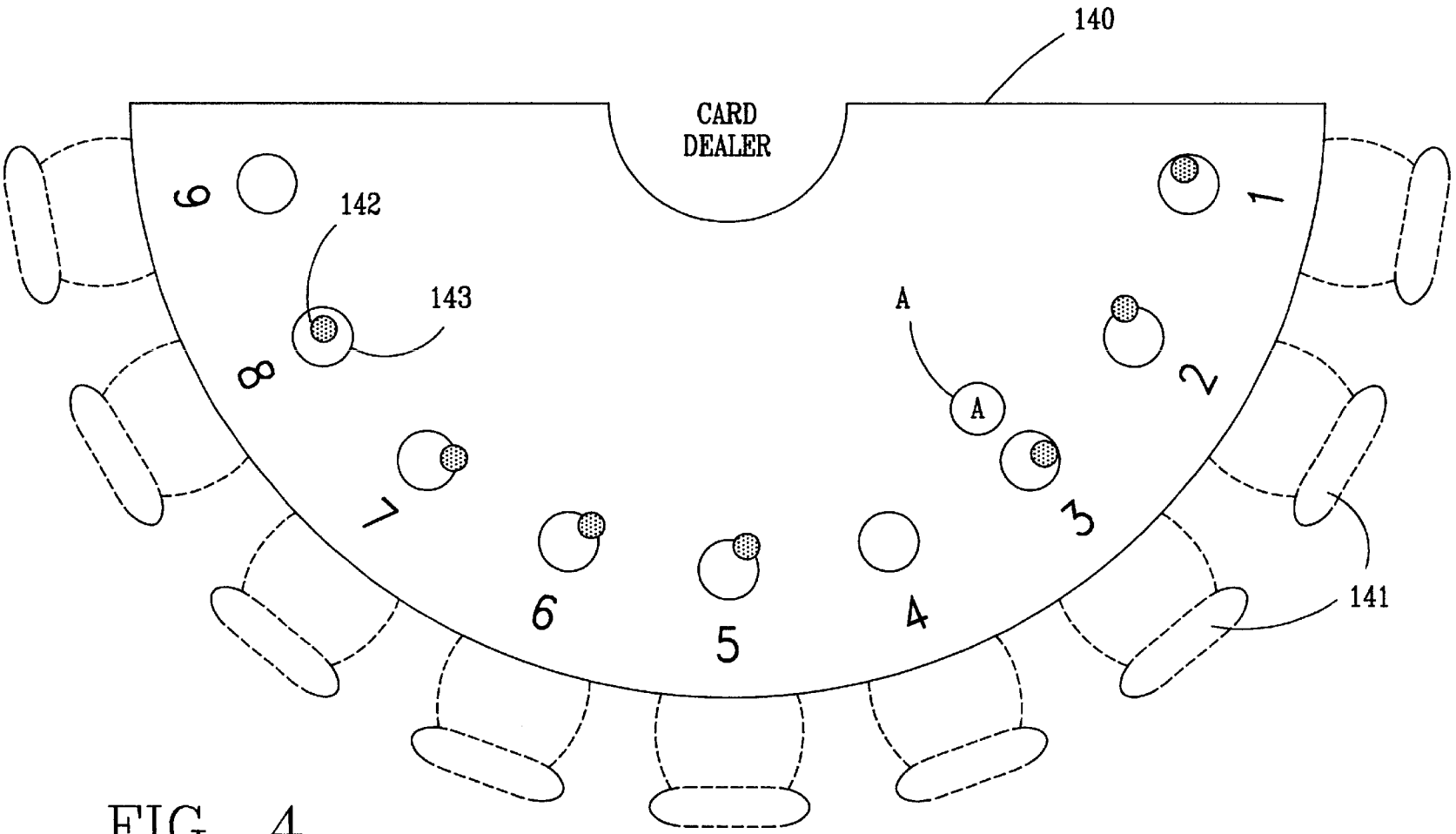
FIG. 4 is a plan view of a playing table layout of a second embodiment of the present invention.

The second embodiment of the present invention, Card Game Two, is shown in the flow diagram of FIG. 3, which illustrates the steps of play. FIG. 4 shows a typical table layout adapted to accommodate up to nine players. Card Game Two is similar to Card Game One, the major difference being that the card dealer is not a participant in the game. In other words, the card dealer is not dealt a hand. Like Card Game One, the object of Card Game Two is to reach, but not exceed, a numerical total of 21. Cards are valued as in conventional Blackjack. However, in the preferred embodiment, a "natural 21", that is Ace/King, Ace/Queen, Ace/Jack or Ace/Ten beats all other hands totaling to 21.

Referring now to FIGS. 3 and 4, the method of playing Card Game 2, generally designated 100 comprises a series of step, the first step 111 being the start of the game. As in Card Game One, the playing table 140 includes a plurality of playing positions 141. Preferably, the table 140 includes eight (8) playing positions, representing playing positions one (1) through eight (8) respectively, although nine (9) playing positions are contemplated to be within the scope of the present invention. Each of the players then places a wager 142 in the respective betting area 143 in step 112. The wagers 142 can be identical, can be identical and equal to a predetermined table limit, or can be varied within the table limits, that is spread-betting. In an alternate embodiment, each player can be required to contribute a table collection fee per hand, preferably between about $0.50 per hand and about $2.00 per hand, which is retained by the house.

Once all wagers 142 have been placed, an action player is selected in step 113. The action player can be selected by any method as described above. Preferably, the action player is selected by the rolling of the three special dice described in U.S. Pat. No. 5,620,153.

When nine (9) players are seated at the table, the action player can be determined by the rolling of two special dice, also described in U.S. Pat. No. 5,620,153 to Skratulia, issued Apr. 15, 1997, the disclosure of which is incorporated be reference. When the set of two special dice is rolled, a total of one to nine will be produced. Whatever total is rolled, the player seated at that playing position will be the selected action player. An action button A is placed next to the action player's betting area 143 and the game proceeds to step 114.

In step 114, the card-dealer sequentially deals cards to the players, beginning with the action player; the cards being dealt face down. Following the dealing of cards, the action player acts on his hand in step 115, followed by each sequential player until each player has acted on his hand in step 116 or opts to surrender (unless the action player has exposed a natural blackjack).

The action player and next sequential player compare hands in step 117. The player with the better hand collects the lesser of the two wagers in step 118 and the action button A; the losing player being retired from the fast action round. If there is a tie between the action player and next sequential player, the action player remains the action player and the next sequential player receives back his wager and is retired from the fast action round. Steps 117 and 118 are repeated until each sequential player has participated in the fast action round.

Like Card Game One, when both hands are a "tie", a push is declared, the sequential player is retired from the fast action round and the action player proceeds to the next fast action play. In addition, any player with a Blackjack cannot expose the Blackjack hand until it is his turn to act in step 116. Once a blackjack hand is exposed, none of the remaining players is allowed to draw cards or is allowed to surrender.

In an alternative embodiment, rather than a natural Blackjack beating all other hands, the winning hand can be two Aces. In other words, a hand of Ace-Ace beats all other hands. The two options for ranking hands is shown in the Table 1 and Table 2. In this alternative embodiment, a sequential player also is not allowed to surrender when an Ace—Ace hand is exposed.

Figure 5:
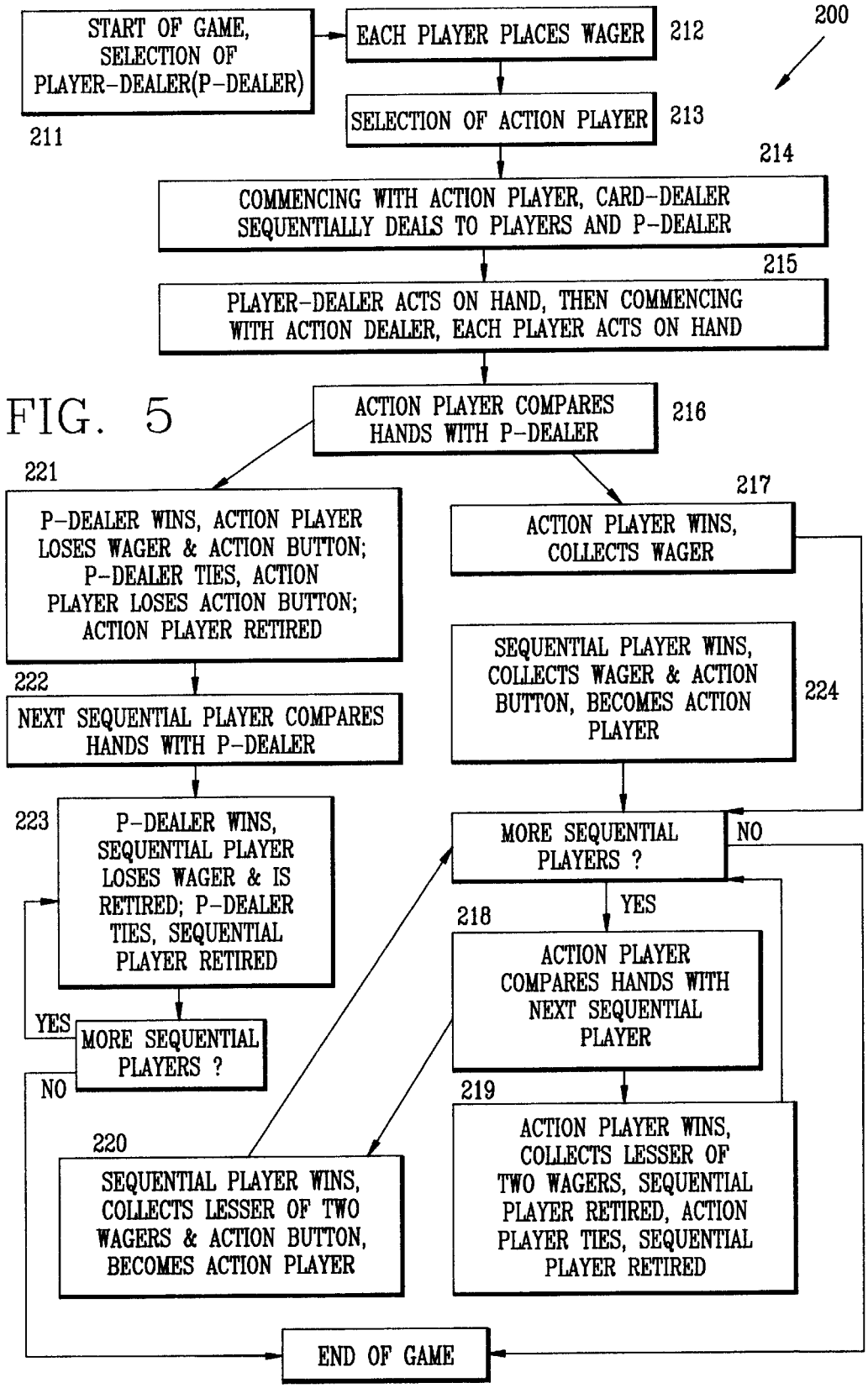
FIG. 5 is a flow diagram illustrating the several steps of playing a third embodiment of the wagering card game of the present invention.
Figure 6:
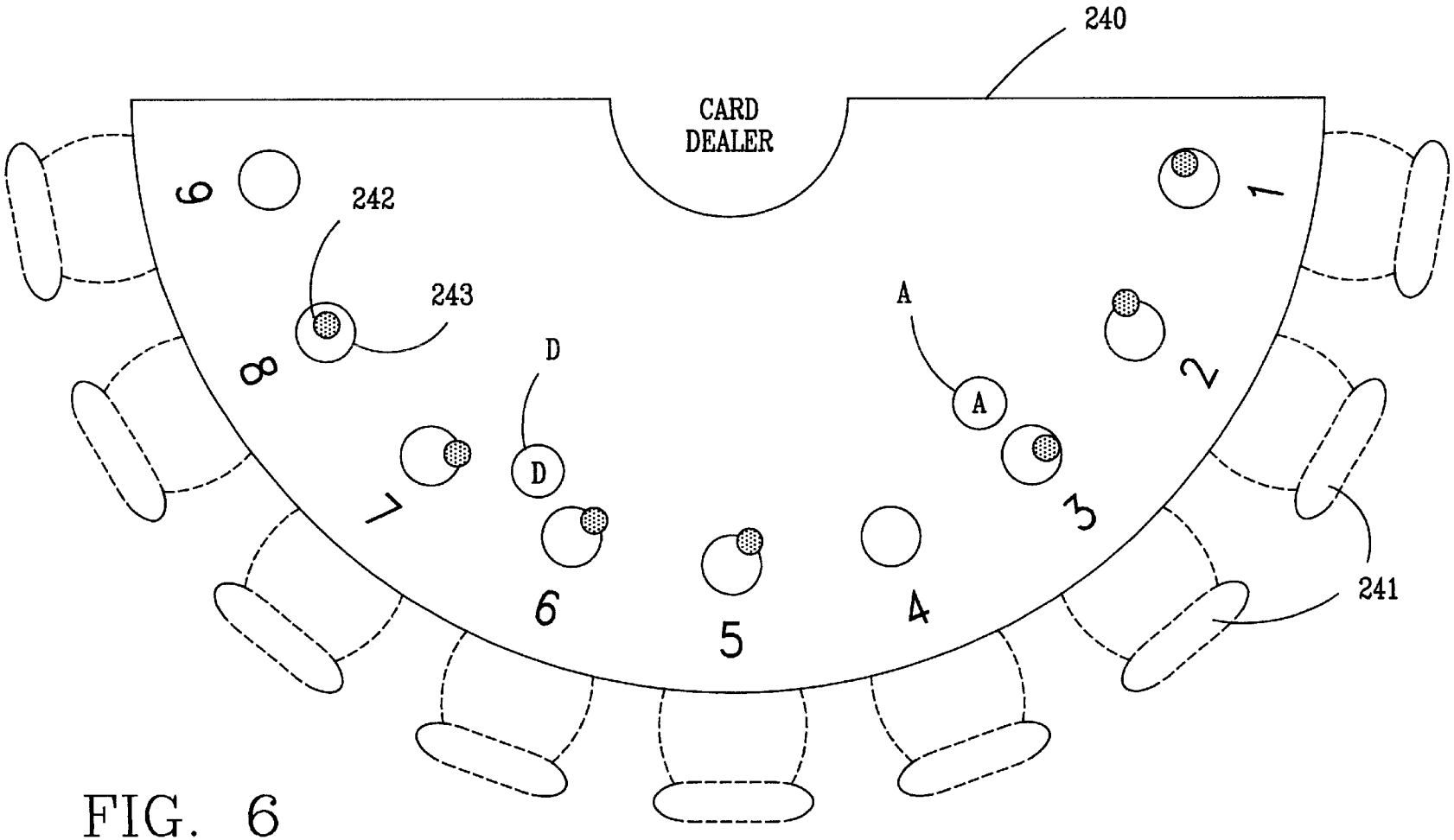
FIG. 6 is a plan view of a playing table layout of a third embodiment of the present invention.

The third embodiment of the present invention, Card Game Three, is shown in the flow diagram of FIG. 5, which illustrates the steps of play. FIG. 6 shows a typical table layout including a table 250 having a plurality of playing positions 251, preferably one (1) through eight (8) playing positions, although nine (9) playing positions are contemplated to be within the scope of the present invention. Card Game Three is a variation of Card Game Two, the primary difference being the selection of a "player-dealer" from the participating players seated at the table. The term "player-dealer" denotes that a particular player acts first and covers the largest allowable wager placed on the table, if the hand with that wager comes into play against the player-dealer. However, the player-dealer does not deal cards. The player-dealer also can be required to contribute a player-dealer collection fee to the house, which is retained by the house. The player-dealer collection fee can be any legally acceptable amount established by the house. Preferably, the player-dealer collection fee per hand is between about $3.00 and $5.00. Because of the potential additional cost to the several players seated at the table, not every player must participate in the player-dealer selection process.

The player-dealer can be selected in variety of ways. Most simply, the player seated in playing position (1) can be selected the player-dealer if the first game played, followed by the player seated in playing position (2) being selected the player-dealer in the next game played and in successive games, the player-dealer being selected in rotational order around the table. If the playing position is unoccupied, then the next sequential player is selected player-dealer. The player-dealer also can be selected in the same manner as the action player, if desired.

Referring now to FIGS. 5 and 6, the method of playing Card Game Three, generally designated 200 comprises a series of step, the first step 211 being the start of the game and the selection of the player-dealer. Once the player-dealer has been selected, a dealer button D is placed on the playing table 240, next to the player-dealer's betting area 243. Each of the remaining players then places a wager 242 in the respective betting area 243 in step 212. Each player can be required to contribute a table collection fee per hand, preferably between about $0.50 per hand and about $2.00 per hand, which is retained by the house.

Once all wagers 242 have been placed, an action player is selected in step 213. The action player can be selected by any method as described above. An action button A is placed next to the action player's betting area 243 and the game proceeds to step 214 and a card-dealer sequentially deals cards to the players and player-dealer, beginning with the action player; the cards being dealt face down to the players and face up to the player-dealer. Following the dealing of cards, the player-dealer acts on his hand in step 215. As in Card Game One, the player-dealer must hit when the numerical total of his cards equals 11 or less and on "soft 17", and must stand on "hard 12 or more" or on "soft 18 or more".

The action player then acts on his hand in step 215 followed by each sequential player until each player has acted on his hand in step 215 or opts to surrender. The action player and player-dealer then compare hands in step 216. If the player-dealer wins, the action player loses his wager and the action button; the action player is retired from the fast action round as illustrated in step 221. If the player-dealer ties, the action player receives back his wager and is retired from the round of play; the action button is passed to the dealer. When there are more sequential players, the next sequential player compares his hand with the player-dealer in step 222. As illustrated in step 223, if the player-dealer has the better hand, the sequential player loses his wager and is retired from the fast action round; if the player-dealer has a tying hand, the player-dealer receives back his wager and is retired. Steps 222 and 223 are repeated until a sequential player has a better hand than the player-dealer or until all players have participated in the fast action round. In this manner, if the player-dealer has the best hand, he has the opportunity to win every wager placed at the table. If the sequential player has a better hand as illustrated in step 224, he collects his wager from the player-dealer, the action button 243 is passed to him and he becomes the action player and proceeds to step 218.

If the action player has the better hand in step 216, the player-dealer loses and the action player collects his wager, as illustrated in step 217. The fast action round continues to step 218 and action player and the next sequential player compare hands. If the action player has the better hand, he collects the lesser of the two wagers and the sequential player is retired from the fast action round as illustrated in step 219. When there is a tie between the action player and next sequential player, the action player retains the action button while the next sequential player receives back his wager and is retired, as illustrated in step 219. When the sequential player has the better hand, he collects the lesser of the two wages and the action button and becomes the action player as illustrated in step 220. Steps 218, 219 and 220 are repeated until all players have participated in the fast action round.

In the third embodiment, the same rules relating to a "push", a natural Blackjack and the option of surrender in the first two embodiments are applied. Like Card Game Two, in Card Game Three, rather than a natural Blackjack beating all other hands, the winning hand can be two Aces. In other words, a hand of Ace-Ace beats all other hands. The two options for ranking hands is shown in the following Table 1 and Table 2. In this alternative embodiment, a sequential player also is not allowed to surrender when an Ace—Ace hand is exposed.

TABLE 1

Ranking of Hands - Option 1

| Rank | Hand |
|---|---|
| 1st | Ace - King |
| | Ace - Queen |
| | Ace - Jack |
| | Ace - Ten |
| 2nd | Total of 21 |
| | (example: 6, 5, King) |
| 3rd | Total of 20 |
| 4th | Total of 19 |
| 5th | Total of 18 |
| 6th | Total of 17 |
| 7th | Total of 16 |
| 8th | Total of 15 |
| 9th | Total of 14 |
| 10th | Total of 13 |
| 11th | Total of 12 |

TABLE 2

Ranking of Hands - Option 2

| Rank | Hand |
|---|---|
| 1st | Ace - Ace |
| 2nd | Ace - King |
| | Ace - Queen |
| | Ace - Jack |
| | Ace - Ten |
| 3rd | Total of 21 |
| | (example: 6, 5, King) |
| 4th | Total of 20 |
| 5th | Total of 19 |
| 6th | Total of 18 |
| 7th | Total of 17 |
| 8th | Total of 16 |
| 9th | Total of 15 |
| 10th | Total of 14 |
| 11th | Total of 13 |
| 12th | Total of 12 |

For each of the three embodiments of the wagering card game of the present invention, the last sequential player, or the last two sequential players, may be given the option of withdrawal when it is his turn to act. The option of withdrawal allows the last sequential player to retire from the card game and receive back his entire wager. The option of withdrawal can be made available when a previous player has exposed a natural Blackjack (or two aces when that is the winning hand) in that round of play, if desired.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A method of playing a wagering card game, the object of which is to obtain, but not exceed, a numerical total of "21", said method utilizing a card-dealer, wherein the participants playing the wagering card game are a plurality of sequential players, comprising the steps of:

(a) each of said plurality of sequential players placing a wager;

(b) selecting an action player from among said plurality of sequential players;

(c) commencing with said action player, said card-dealer sequentially dealing cards to each of said plurality of sequential players, until each of said plurality of sequential players has a hand of two cards;

(d) each player acting on his viewed hand, commencing with said action player;

(e) said action player and the next sequential player revealing and comparing hands to determine the better hand, wherein when said action player has the better hand, the next sequential player is retired from the round of play, and wherein when said action player has a tying hand, said next sequential player is retired from the round of play, and wherein when said next sequential player has the better hand, he is the winner and resulting action player and the former action player is retired from the round of play;

(f) repeating step (e) until all other players have participated, thereby ending said card game, wherein, in step (d) at least the last sequential player can opt to withdraw from said wagering card game, by not acting on his viewed hand, and receive back his entire wager.

2. The method of playing a wagering card game in accordance with claim 1, wherein the winner of the better hand in step (e) collects his wager from the other player.

3. The method of playing a wagering card game in accordance with claim 1, wherein the winner of the better hand in step (e) collects the lesser of the said wagers placed by the action player and next sequential player.

4. The method of playing a wagering card game in accordance with claim 1, wherein said plurality of sequential players is up to eight sequential players, each of said sequential players having a unique playing position sequentially numbered one (1) through eight (8), and wherein said action player is selected by the rolling of three dice which when rolled produce a total of from one (1) to eight (8), such that the player seated at the unique playing position equaled to the total of said rolled dice is selected the action player.

5. The method of playing a wagering card game in accordance with claim 1, wherein a hand of "natural 21" is a better hand than any other hand totaling twenty-one (21).

6. The method of playing a wagering card game in accordance with claim 1, wherein a hand of two aces is a better hand than any other hand.

7. The method of playing a wagering card game in accordance with claim 1, further comprising an option to surrender, wherein each of said sequential players can select an option to surrender rather than acting on his hand, thereby retiring from the round of play.

8. The method of playing a wagering card game in accordance with claim 7, wherein when a sequential player selects said option to surrender, said sequential player receives back one-half (½) of his wager placed in step (a).

9. The method of playing a wagering card game in accordance with claim 7, wherein said option to surrender is not available after any of said plurality of sequential players has revealed a hand of Blackjack.

10. The method of playing a wagering card game in accordance with claim 1, wherein each of said plurality of sequential players contributes a table collection fee per hand.

11. The method of playing a wagering card game in accordance with claim 1, wherein an action button is used to identify the selected action player and any resulting action player.

12. The method of playing a wagering card game in accordance with claim 1, wherein said card-dealer is a house-dealer and is dealt a hand of two cards in step (c), further comprising, after step (c) and before step (d), the step of:

(c1) said house-dealer acting on his hand; and, after step (d) and before step (e), the steps of:

(d1) said house-dealer and said action player comparing hands to determine the better hand, wherein when said action player has the better hand, said action player collects his wager from said house-dealer and proceeds to step (e) and wherein said house-dealer has a tying hand or the better hand, said action player is retired and said house-dealer proceeds to step (d2);

(d2) said house-dealer and the next sequential player comparing hands to determine the better hand, wherein, when the house-dealer has a better hand, said next sequential player loses his wager and is retired, when said house-dealer has a tying hand, said next sequential player is retired and when said next sequential player has a better hand, he collects his wager and becomes the resulting action player and proceeds to step (e), wherein step (d2) is repeated until a next sequential player has a better hand than the house-dealer and proceeds to step (e) or until all other players have participated, thereby ending said card game.

13. The method of playing a card game in accordance with claim 12, wherein in step (c), said house-dealer is required to draw additional cards when the sum total of said house-dealer's hand is a hard eleven (11) or less and on a soft seventeen (17) and is prohibited from drawing additional cards on a hard twelve (12) or more or on a soft eighteen (18) or more.

14. The method of playing a card game in accordance with claim 12, wherein in step (c), cards to said house-dealer are dealt face-up and cards to each of said plurality of sequential players are dealt face-down.

15. The method of playing a wagering card game in accordance with claim 1, wherein said card-dealer is a player-dealer is selected from said plurality of sequential players.

16. The method of playing a wagering card game in accordance with claim 15, wherein said plurality of sequential players is up to eight sequential players, each of said sequential players having a unique playing position sequentially numbered one (1) through eight (8), and wherein the sequential player seating in playing position numbered one (1) is selected said player-dealer.

17. The method of playing a card game in accordance with claim 16, wherein when no player is seated in playing position numbered one (1), said player seated in the next sequential playing position is selected said player-dealer.

18. The method of playing a card game in accordance with claim 15, wherein said player-dealer contributes a player-dealer collection fee per hand.

19. A method of playing a wagering card game, the object of which is to obtain, but not exceed, a numerical total of 21, wherein the participants playing the wagering card game include a house-dealer and a plurality of sequential players, comprising the steps of:

(a) each of said plurality of sequential players placing a wager;

(b) selecting an action player from among said plurality of sequential players;

(c) commencing with said action player, said house-dealer sequentially dealing cards to each of said plurality of sequential players and to said house-dealer, until each of said plurality of sequential players and said house-dealer has a hand of two cards;

(d) said house-dealer acting on his hand;

(e) commencing with said action player, each player acting on his hand;

(f) said house-dealer and said action player comparing hands to determine the better hand, wherein when said action player has the better hand, said action player collects his wager from said house-dealer and proceeds to step (h) as a resulting action player and said house dealer is retired from the round of play, and wherein when said house-dealer has the better hand or tying hand, said action player is retired from the round of play and said house-dealer proceeds to step (g), and wherein when said house-dealer has a better hand, said action player loses his wager;

(g) the next sequential player comparing his hand with the house-dealer to determine the better hand, wherein, when the house-dealer has a better hand, said next sequential player loses his wager and is retired, when said house-dealer has a tying hand, said next sequential player is retired and when said next sequential player has a better hand, he collects his wager and becomes the resulting action player and proceeds to step (h), wherein step (g) is repeated until a next sequential player has a better hand than the house-dealer and proceeds to step (h) or until all other players have participated, thereby ending said card game;

(h) said action player and the next sequential player revealing and comparing hands to determine the better hand, wherein when said action player has the better hand or a tying hand, the next sequential player is retired from the round of play, and when said next sequential player has the better hand, he is the winner and resulting action player and the former action player is retired from the round of play;

(i) repeating step (h) until all other players have participated, thereby ending said card game.

20. The method of playing a wagering card game in accordance with claim 19, wherein the player with better hand in step (h) collects his wager from the player with the losing hand.

21. The method of playing a wagering card game in accordance with claim 19, wherein the winner of the better hand in step (h) collects the lesser of the two wagers from the other player.

22. The method of playing a wagering card game in accordance with claim 19, wherein said plurality of sequential players is up to eight sequential players, each of said sequential players having a unique playing position sequentially numbered one (1) through eight (8), and wherein said action player is selected by the rolling of three dice which when rolled produce a total of from one (1) to eight (8), such that the player seated at the unique playing position equaled to the total of said rolled dice is selected the action player.

23. The method of playing a wagering card game in accordance with claim 19, wherein a hand of "natural 21" is a better hand than any other hand totaling twenty-one (21).

24. The method of playing a wagering card game in accordance with claim 19, wherein a hand of two aces is a better hand than any other hand.

25. The method of playing a wagering card game in accordance with claim 19, further comprising an option to surrender, wherein each of said sequential players can select an option to surrender rather than acting on his hand, thereby retiring from the round of play.

26. The method of playing a wagering card game in accordance with claim 25, wherein when a sequential player selects said option to surrender, said sequential player receives back one-half (½) of his wager placed in step (a).

27. The method of playing a wagering card game in accordance with claim 25, wherein said option to surrender is not available after any of said plurality of sequential players has revealed a hand of Blackjack.

28. The method of playing a wagering card game in accordance with claim 25, further comprising an option of withdrawal, wherein at least the last sequential player can select an option of withdrawal, rather than acting on his hand, and receive back at least one half (½) of his wager.

29. The method of playing a wagering card game in accordance with claim 19, wherein each of said plurality of sequential players contributes a table collection fee per hand.

30. The method of playing a wagering card game in accordance with claim 19, wherein an action button is used to identify the selected action player and any resulting action player.

31. The method of playing a card game in accordance with claim 19, wherein in step (c), said house-dealer is required to draw additional cards when the sum total of said house-dealer's hand is a hard eleven (11) or less and on a soft seventeen (17) and is prohibited from drawing additional cards on a hard twelve (12) or more or on a soft eighteen (18) or more.

32. The method of playing a card game in accordance with claim 19, wherein in step (c), cards to said house-dealer are dealt face-up and cards to each of said plurality of sequential players are dealt face-down.

33. A method of playing a wagering card game, the object of which is to obtain, but not exceed, a numerical total of "21", said method utilizing a card-dealer, wherein the participants playing the wagering card game are a plurality of sequential players, comprising the steps of:

(a) selecting a player-dealer from said plurality of sequential players;

(b) each of the remaining said plurality of sequential players placing a wager;

(c) selecting an action player from among the remaining said plurality of sequential players;

(d) commencing with said action player, said card-dealer sequentially dealing cards to each of said plurality of sequential players, until each of said plurality of sequential players has a hand of two cards;

(e) said player-dealer acting on his hand;

(f) commencing with said action player, each player acting on his hand;

(g) said player-dealer and said action player comparing hands to determine the better hand, wherein when said action player has the better hand, said action player collects his wager from said player-dealer and proceeds to step (i) as a resulting action player, when said player-dealer has the better hand or a tying hand, said action player is retired and said player dealer proceeds to step (h), and wherein when said player-dealer has a better hand, said action player loses his wager;

(h) said player-dealer and the next sequential player comparing hands to determine the better hand, wherein, when the player-dealer has a better hand, said next sequential player loses his wager and is retired, when said player-dealer has a tying hand, said next sequential player is retired and when said next sequential player has a better hand, he collects his wager and becomes the resulting action player and proceeds to step (i), and said player-dealer is retired from the round of play, wherein step (h) is repeated until a next sequential player has a better hand than the player-dealer and proceeds to step (i) or until all other players have participated, thereby ending said card game;

(i) said resulting action player and said next sequential player revealing and comparing hands to determine the better hand, wherein the player with the better hand is the winner and becomes the resulting action player and the other player is retired from the round of play and wherein when the resulting action player has a tying hand, the next sequential player is retired from the round of play, and (j) repeating step (i) until all other players have participated, thereby ending said card game.

34. The method of playing a wagering card game in accordance with claim 33, wherein the winner of the better hand in step (i) collects his wager from the other player.

35. The method of playing a wagering card game in accordance with claim 33, wherein the winner of the better hand in step (i) collects the lesser of the two wagers from the other player.

36. The method of playing a wagering card game in accordance with claim 33, wherein said plurality of sequential players is up to eight sequential players, each of said sequential players having a unique playing position sequentially numbered one (1) through eight (8), and wherein said action player is selected by the rolling of three dice which when rolled produce a total of from one (1) to eight (8), such that the player seated at the unique playing position equaled to the total of said rolled dice is selected the action player.

37. The method of playing a wagering card game in accordance with claim 33, wherein a hand of "natural 21" is a better hand than any other hand totaling twenty-one (21).

38. The method of playing a wagering card game in accordance with claim 33, wherein a hand of two aces is a better hand than any other hand.

39. The method of playing a wagering card game in accordance with claim 33, further comprising an option to surrender, wherein each of said sequential players can select an option to surrender rather than acting on his hand, thereby retiring from the round of play.

40. The method of playing a wagering card game in accordance with claim 39, wherein when a sequential player selects said option to surrender, said sequential player receives back one-half (½) of his wager placed in step (a).

41. The method of playing a wagering card game in accordance with claim 39, wherein said option to surrender is not available after any of said plurality of sequential players has revealed a hand of Blackjack.

42. The method of playing a wagering card game in accordance with claim 39, further comprising an option of withdrawal, wherein at least the last sequential player can select an option of withdrawal, rather than acting on his hand, and receive back at least one half (½) of his wager.

43. The method of playing a wagering card game in accordance with claim 33, wherein each of said plurality of sequential players contributes a table collection fee per hand.

44. The method of playing a wagering card game in accordance with claim 33, wherein an action button is used to identify the selected action player and any resulting action player.

45. The method of playing a card game in accordance with claim 33, wherein in step (c), said player-dealer is required to draw additional cards when the sum total of said player-dealer's hand is a hard eleven (11) or less and on a soft seventeen (17) and is prohibited from drawing additional cards on a hard twelve (12) or more or on a soft eighteen (18) or more.

46. The method of playing a card game in accordance with claim 33, wherein in step (c), cards to said player-dealer are dealt face-up and cards to each of said plurality of sequential players are dealt face-down.

* * * * *